US012685944B2

(12) United States Patent
Mitsuishi et al.

(10) Patent No.: US 12,685,944 B2
(45) Date of Patent: Jul. 21, 2026

(54) TOY FOR TOY SUPPLYING APPARATUS

(71) Applicant: BANDAI CO., LTD., Tokyo (JP)

(72) Inventors: Yoko Mitsuishi, Tokyo (JP); Yoshihiro Murakami, Tokyo (JP)

(73) Assignee: BANDAI CO., LTD., Tokyo (JP)

( * ) Notice: Subject to any disclaimer, the term of this patent is extended or adjusted under 35 U.S.C. 154(b) by 267 days.

(21) Appl. No.: 18/555,528

(22) PCT Filed: Apr. 6, 2022

(86) PCT No.: PCT/JP2022/017211
§ 371 (c)(1),
(2) Date: Oct. 15, 2023

(87) PCT Pub. No.: WO2022/270125
PCT Pub. Date: Dec. 29, 2022

(65) Prior Publication Data

US 2024/0216826 A1 Jul. 4, 2024

(30) Foreign Application Priority Data

Jun. 25, 2021 (JP) ..... 2021-105621

(51) Int. Cl.
*A63H 33/00* (2006.01)
*A63H 3/50* (2006.01)

(52) U.S. Cl.
CPC ..... *A63H 33/003* (2013.01); *A63H 3/50* (2013.01)

(58) Field of Classification Search
CPC ..... A63H 3/50; A63H 33/003; A63H 33/086; A63H 33/088
See application file for complete search history.

(56) References Cited

U.S. PATENT DOCUMENTS 4,964,831 A * 10/1990 Wolff ..... A63H 3/50 446/268
5,209,345 A * 5/1993 Haugabook ..... G09B 19/00 206/1.5

(Continued)

FOREIGN PATENT DOCUMENTS

CN 107960060 A 4/2018
CN 109718564 A 5/2019

(Continued)

OTHER PUBLICATIONS

WIPO, International Search Report for International Application No. PCT/JP2022/017211, May 17, 2022.

(Continued)

*Primary Examiner* — Nicholas J. Weiss
(74) *Attorney, Agent, or Firm* — IMAIZUMI IP LAW, PLLC; Toshikatsu Imaizumi

(57) ABSTRACT

Provided herein is a toy having a high attractiveness. The toy be transformed into a first form where the toy can be supplied from an article supply device, and a second form where an object can be displayed, and comprises a main part in a spherical shape. A first flat portion is formed on a first portion of an outer surface of the main part, and a second flat portion is formed on a second portion thereof, which is different from the first portion. Since the first flat face portion and the second flat face portion is formed as a flat part on an outer surface, the main part can be stably placed on a placing face when the main part is used in a display form (the second form).

16 Claims, 13 Drawing Sheets

(56) References Cited

U.S. PATENT DOCUMENTS

| | | | | | |
|---|---|---|---|---|---|
| 5,287,979 | A * | 2/1994 | Bourgeois | A47G 19/28 | 220/523 |
| 7,306,504 | B2 * | 12/2007 | Saucier | A63H 33/003 | 446/268 |
| 9,539,519 | B2 * | 1/2017 | Vollers | A63H 33/08 | |
| 10,293,270 | B1 * | 5/2019 | Fontaine | A63H 33/086 | |
| 11,376,515 | B1 * | 7/2022 | Livingston | A63H 3/365 | |
| 12,208,341 | B2 * | 1/2025 | Iwawaki | A63H 3/50 | |
| 2007/0197124 | A1 * | 8/2007 | Sato | A63H 33/26 | 446/99 |
| 2019/0358552 | A1 | 11/2019 | Saul | | |
| 2020/0330895 | A1 * | 10/2020 | Hansen | A63H 33/086 | |

FOREIGN PATENT DOCUMENTS

| | | | | |
|---|---|---|---|---|
| JP | H07-148358 | A | | 6/1995 |
| JP | 2003-275476 | A | | 9/2003 |
| JP | 2004-453 | A | | 1/2004 |
| JP | 2008-36348 | A | | 2/2008 |
| JP | 2008036348 | A | * | 2/2008 |
| JP | 2011-170396 | A | | 9/2011 |
| JP | 3175576 | U | * | 5/2012 |
| JP | 2019-5091 | A | | 1/2019 |
| JP | 2019-17465 | A | | 2/2019 |
| JP | 2019017465 | A | * | 2/2019 ..... A63H 3/36 |
| JP | 2020-15533 | A | | 1/2020 |
| JP | 2020015533 | A | * | 1/2020 |
| JP | 2021-083495 | A | | 6/2021 |
| KR | 10-1032609 | B1 | | 5/2011 |
| WO | 2019106988 | A1 | | 6/2019 |

OTHER PUBLICATIONS

WIPO, Written Opinion for International Application PCT/JP2022/017211, May 17, 2022.

JPO, Office Action for Japanese Patent Application No. 2021-105621, Mar. 2, 2022.

JPO, Office Action for Japanese Patent Application No. 2022-085324, Apr. 7, 2025.

China National Intellectual Property Administration, Search Report for Chinese Patent Application No. 202210598145, May 9, 2023.

China National Intellectual Property Administration, Office Action for Chinese Patent Application No. 202210598145, May 9, 2023.

* cited by examiner

TOY FOR TOY SUPPLYING APPARATUS

TECHNICAL FIELD

The present invention relates to a toy.

BACKGROUND

Conventionally, there are capsule toys sold by a vending machine in each of which a doll etc. is included. For example, in Patent Document 1, parts to be assembled are contained in such a capsule composed of capsule constituent members. A predetermined number of cutouts are formed in a cut part of each of the capsule constituent members, and some of or all of the parts are respectively inserted in the cutouts thereby completing a toy. In addition, it is disclosed therein that ribs for holding the cut part of the capsule constituent member are formed on an inner wall of the capsule constituent member in order to prevent the capsule from dropping.

PRIOR ART

Patent Documents

[Patent Document 1] Japanese Patent Application Publication No. H07-148358

SUMMARY

Technical Problem

Patent Document 1 discloses a configuration in which a capsule itself is used as parts of the toy. However, a form in use of the capsule at time when the capsule is used as a part of the toy, is spherical as in the time of sale, so that the shape of the toy depends on the spherical shape of the capsule. Therefore, it is difficult to maintain the original impression of a character. Regarding a certain character, the shape thereof changes because of the capsule shape, thereby causing a quality problem of the character itself whereby amusement property thereof cannot be maintained. In addition, since the overall appearance of the toy itself is spherical as a basic form, there is a problem that the toy is unstable in a displayed state or a placed state and lacks the stableness.

It is an object of the present invention to provide a toy with stableness and high amusement property, which is capable of enhancing an impression of the character in a displayed state and easy to display.

Solution to Problem

One of the aspects of the present invention is a toy capable of a change between a first form where the toy can be supplied from an article supply device, and a second form where an object can be displayed, the toy comprising a main part in a spherical shape, wherein a first flat portion is formed on a first portion of an outer surface, and a second flat portion is formed on a second portion which is different from the first portion.

Advantageous Effect of Invention

It is possible to provide a toy with a high amusement property.

DETAILED DESCRIPTION

Figure 1:
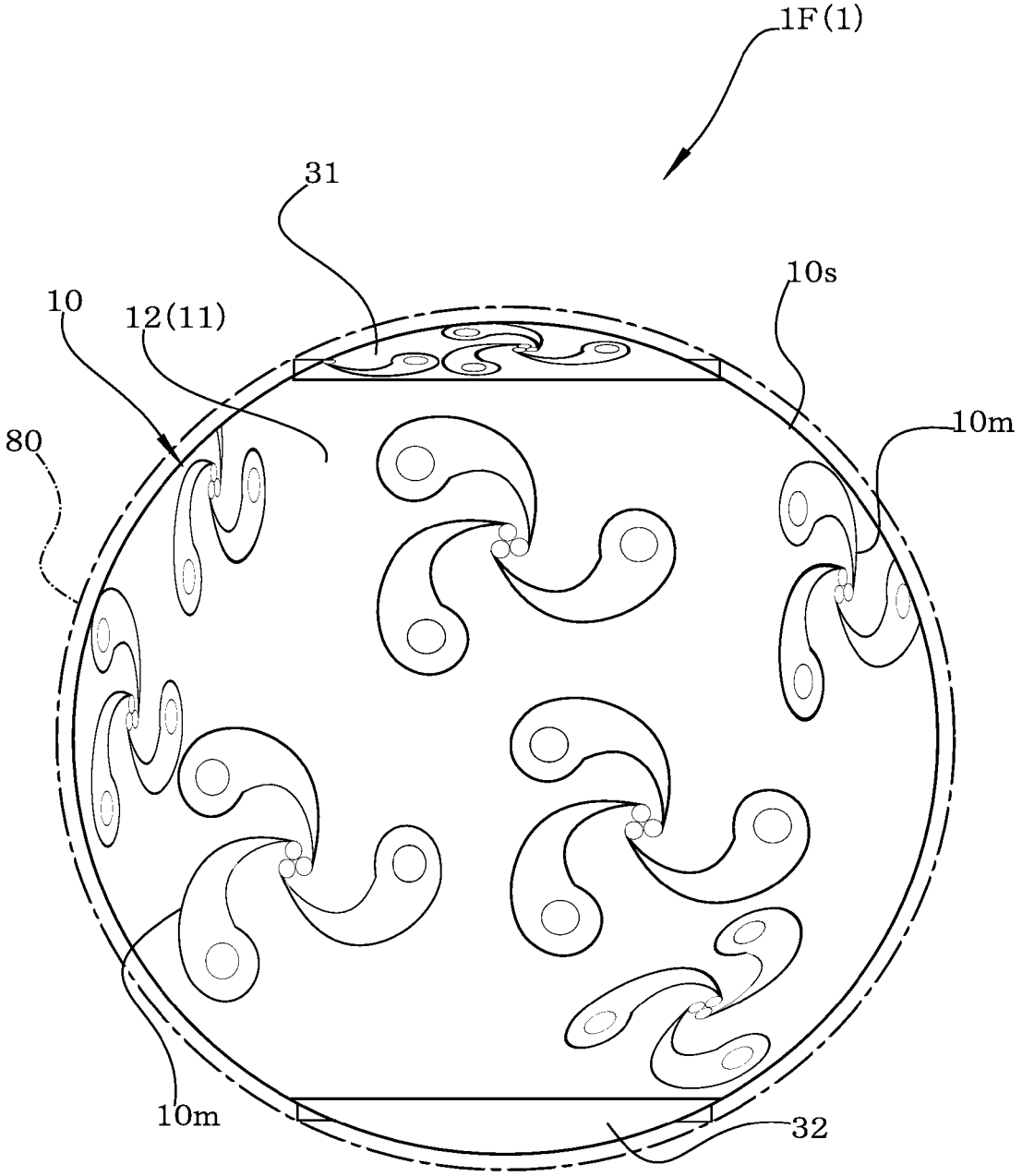
FIG. 1 is a front view of a toy according to an embodiment of the present invention in a first form.
Figure 2:
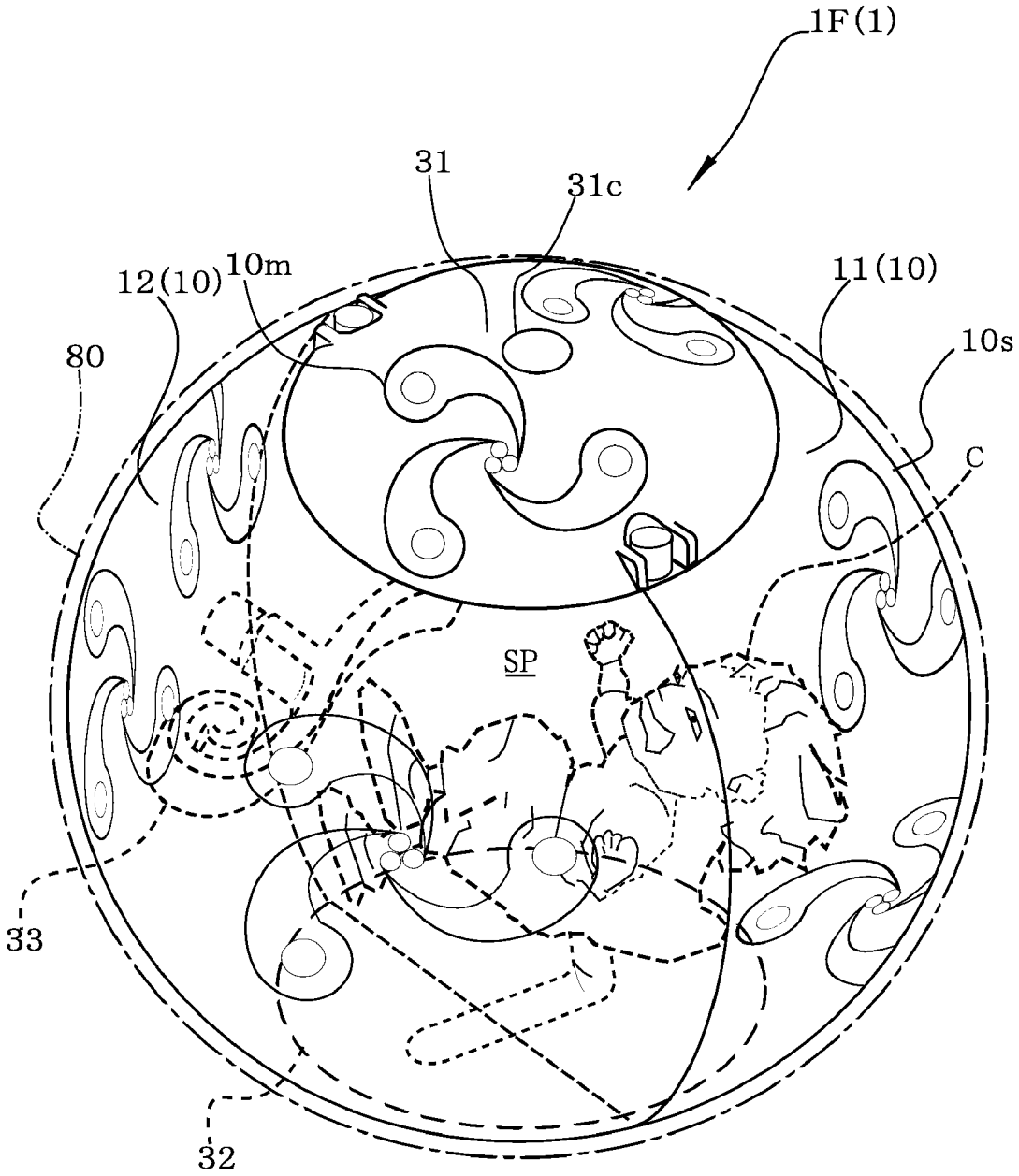
FIG. 2 is a top perspective view of the toy in the first form shown in FIG. 1.

A toy according embodiments of the present invention will be explained, referring to FIGS. 1-13. FIG. 1 is a front view of a toy in a first form 1F. FIG. 2 is a top perspective view of the toy 1 in the first form 1F shown in FIG. 1.

As shown in FIGS. 1 and 2, the toy 1 in the first form 1F has a main part 10 which is made up of a first outer shell component 11 and a second outer shell component 12, and an external appearance thereof is approximately spherical. In the first form 1F, a first subpart 31 is attached to an upper part thereof, and a second subpart 32 is attached to a lower part thereof. The outer surface 10*s* of the toy is composed of the first outer shell component 11, the second outer shell component 12, the first subpart 31 and the second subpart 32. A wrapping film 80 is formed thereon so as to lap the outer surface 10*s*. Thus, the toy is not provided (sold) at a store. Since the toy 1 in the first form 1F is formed in a spherical shape so that the toy itself easily rolls, the toy can be supplied from an article supply device. The article supply device comprises an accommodation unit capable of accommodating a plurality of toys 1 in a non-aligned state, a control unit which can control the toys 1 to be supplied one by one from the accommodation unit on condition of payment of consideration, and a communication path which is connected to a supply port from the accommodation unit. Although the toy is made up of a plurality of parts so that it is easy to separate them from one another, since the toy 1 is formed in a shape by which the toy easily rolls, it is possible to supply the toy 1 to a user without breaking-up or damaging the toy 1 when the toy is supplied from the article supply device.

Further, a pattern 10*m* is formed on the outer surface 10*s*, and a space SP is formed thereinside so that a character C etc., which is an object described later, can be accommodated therein. In addition, the wrapping film 80 can be removed from the toy 1 and the toy can be taken apart so that the content therein can be taken out. Then, an assembly can be made by using the character C, so that the toy can be changed to the second form 2F (refer to FIG. 9) and the third form 3F (refer to FIG. 11).

Figure 3:
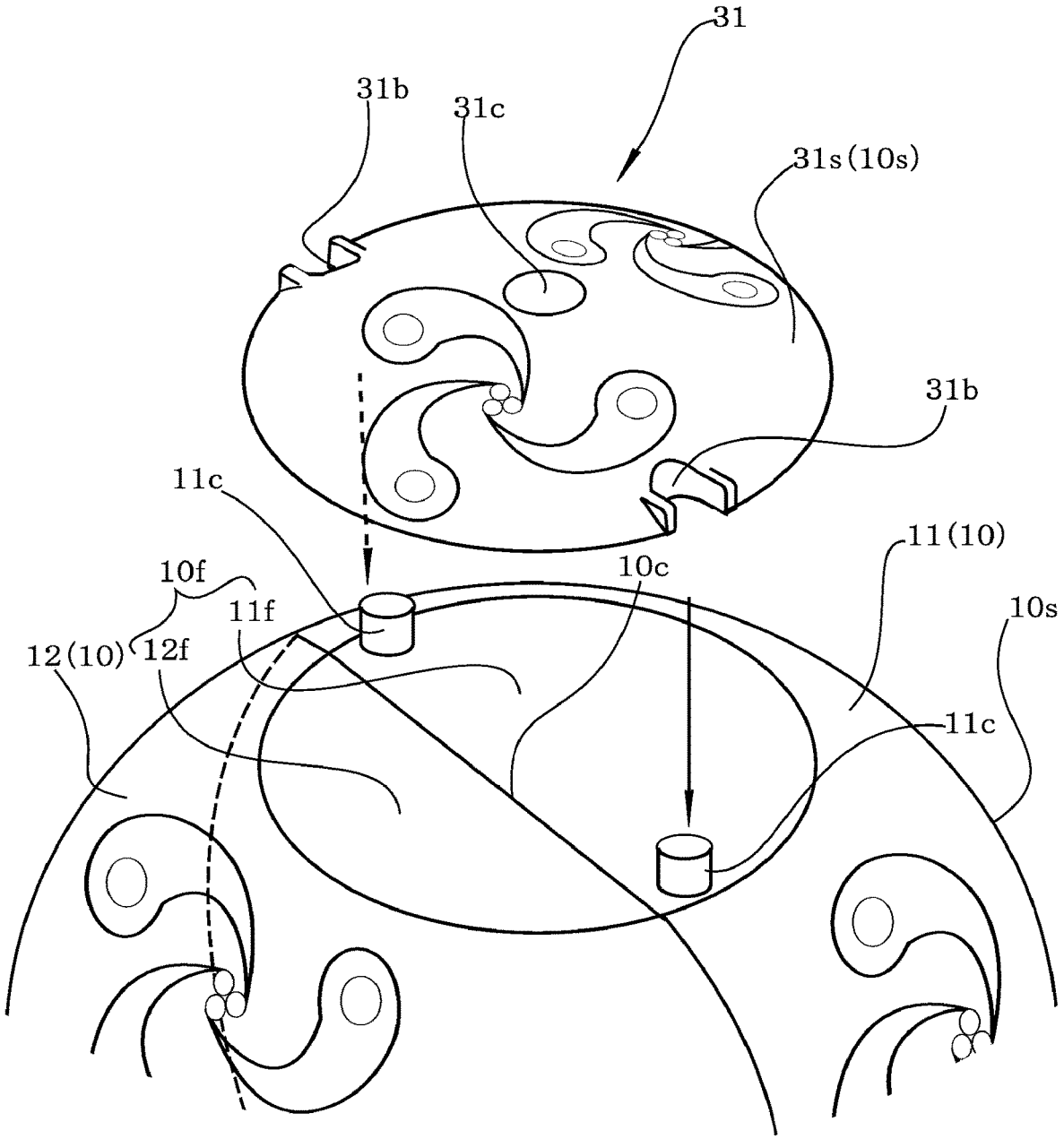
FIG. 3 is a perspective view thereof, showing an attaching structure for a first subpart shown in FIG. 1.
Figure 4:
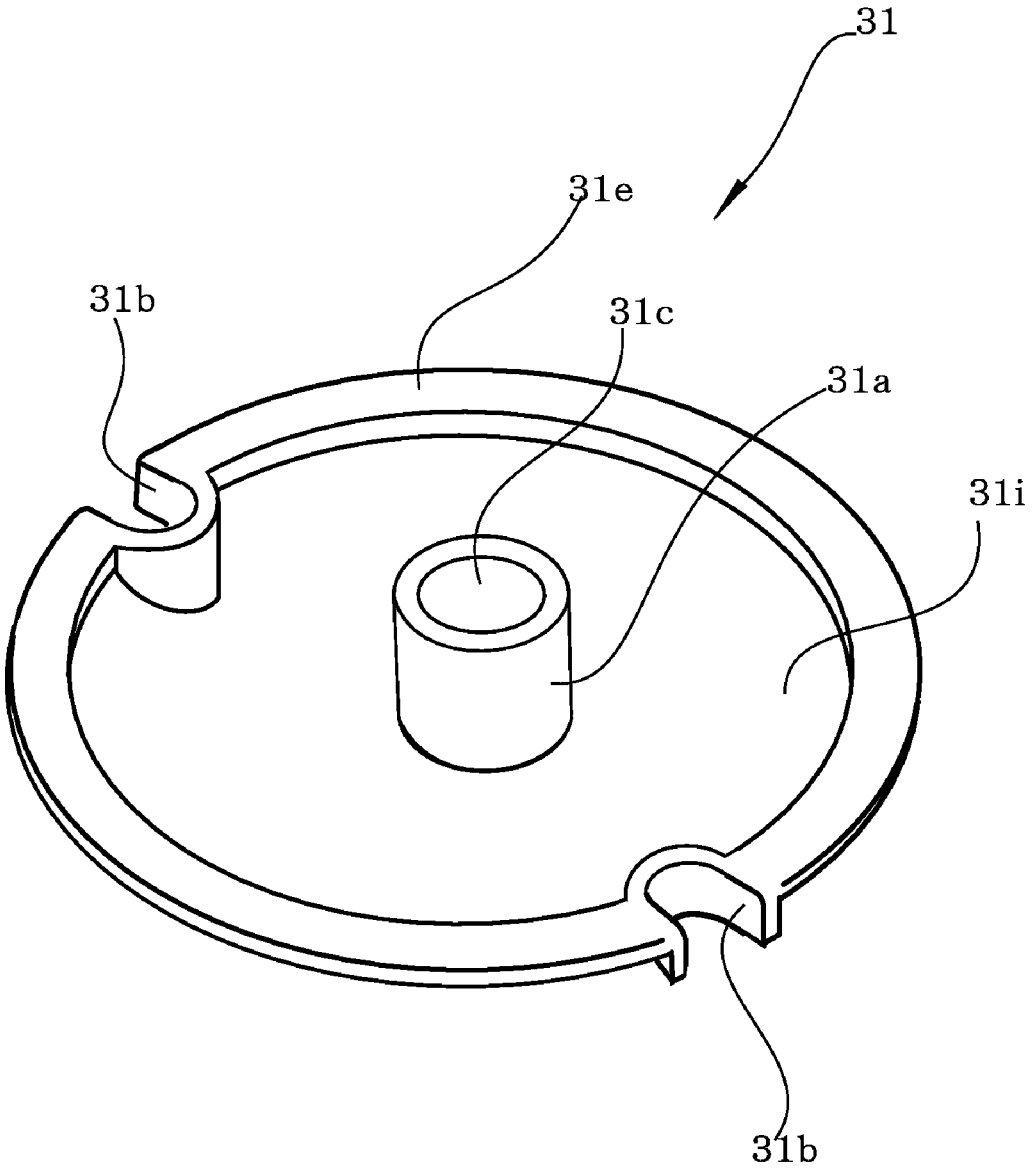
FIG. 4 is a perspective view of the first subpart, showing an inter face thereof.

FIG. 3 is a perspective view of an attaching structure for the first subpart 31, and FIG. 4 is a perspective view of the first subpart, showing an inter face thereof. As shown in FIG. 3, a first flat portion 10*f* is formed on a first portion, which is an upper part of the main part 10, and the approximately disc-shaped first subpart 31 is attached to the first flat portion 10*f*. The first flat portion 10*f* is configured so as to be divided into the first outer shell 11 and the second outer shell 12 along a join line 10*c*. That is, the first flat portion 10*f* has a flat face on which the first apportion portion 11*f* formed on a side of the first outer shell component 11 and a second apportion portion 12*f* formed on a side of the second outer shell component 12 are apportioned. Further, the first outer shell component 11 is formed so as to be larger than the second outer shell component 12, and the size (area) of the first apportion portion 11*f* is also larger than the size (area) of the second apportion portion 12*f*. Furthermore, a pair of cylindrical connecting parts 11*c* is formed at a position adjacent to the join line 10*c*, on a side of the first apportion portion 11*f*.

As shown in FIG. 3, an outer surface 31*s* of the first subpart 31 is formed as a curved face, which is part of the spherical surface (the outer surface 10*s*), and the pattern 10*m* is formed thereon. In addition, a pair of attachment cutouts 31*b* is formed at an outer peripheral edge of the first subpart 31, and an insert hole 31*c* to which a third subpart 33 (refer to FIG. 8) is attached, is formed at center thereof.

On the other hand, as show in FIG. 4, an inner face 31*i* of the first subpart 31 is formed to match with the first flat portion 10*f*. That is, a flat annular flat portion 31*e* having a predetermined width, which is different from the curved surface of the inner face 31*i*, is formed along the inner peripheral edge thereof. Further, a boss section 31*a*, at a center of which the insert hole 31*c* is formed, is arranged to protrude therefrom so that the height thereof is the same as that of the annular flat portion 31*e*. That is, in the first form 1F, the annular flat portion 31*e* and the boss section 31*a* of the first subpart 31 are in contact with the first flat face portion 10*f*, and the cutouts 31*b* are inserted in the pair of first connecting parts 11*c* in a fitting state and so that the first subpart 31 is connected to and cover the first flat portion 10*f*.

Figure 5:
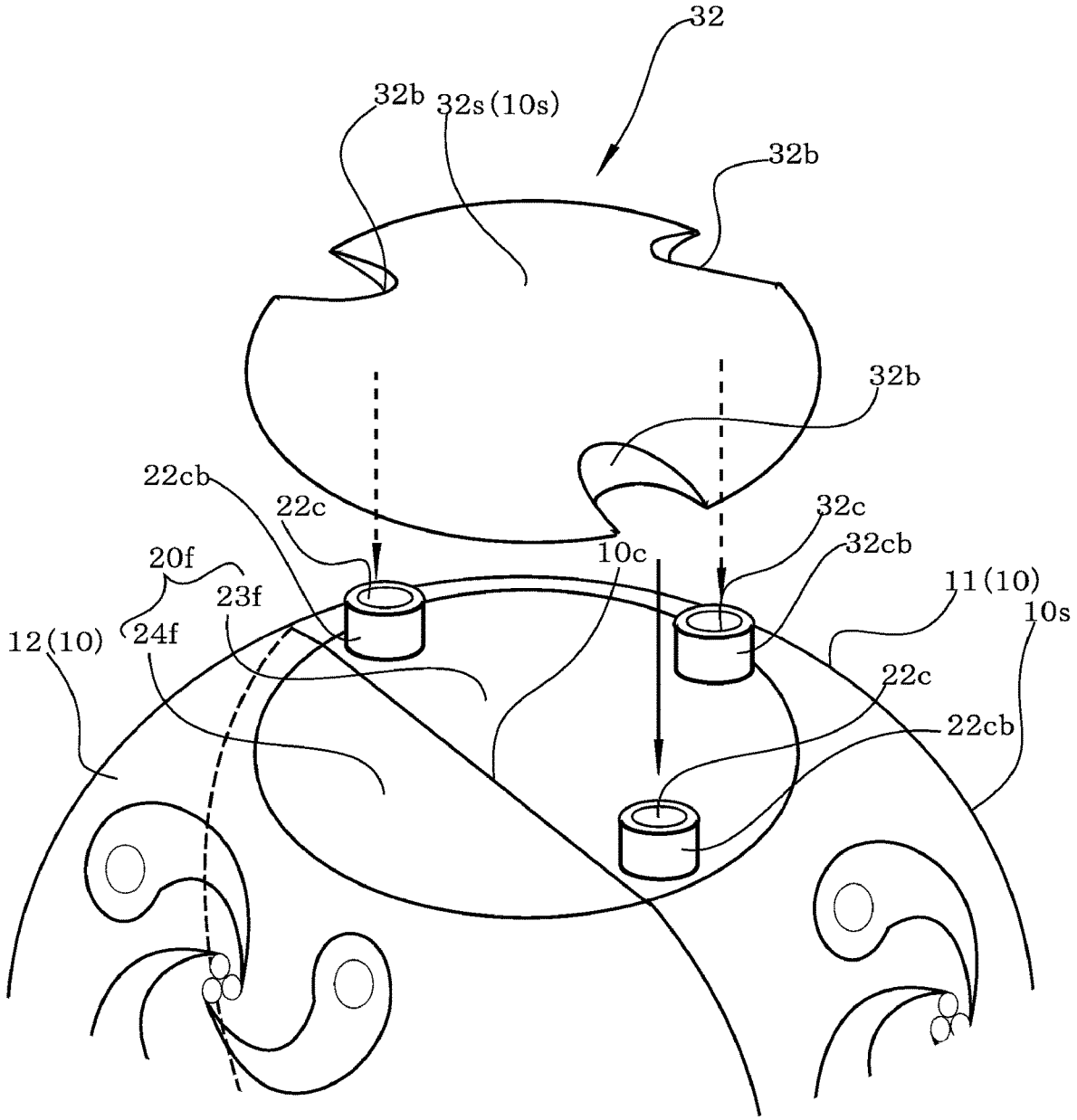
FIG. 5 is a perspective view of an attaching structure for a second subpart shown in FIG. 1.

FIG. 5 is a perspective view of an attaching structure for the second subpart 32. As shown in FIG. 5, a second flat portion 20*f* is formed on a second part which is a lower portion of the main part 10, and the second subpart 32 is attached to the second flat face portion 20*f*. The second flat portion 20*f* is configured so as to be divided into the first outer shell 11 and the second outer shell 12 along a join line 10*c*. That is, the second flat face portion 20*f* is a flat face on which a third apportion portion 23*f* formed on a side of the first outer shell component 11 and a fourth apportion portion 24*f* formed on a side of the second outer shell component 12 are apportioned. The second flat face portion 20*f* is formed so that the size of the second flat face portion 20*f* is the same as that of the first flat face portion 10*f*. Further, the size (area) of the third apportion portion 23*f* is configured so as to be larger than the size (area) of the fourth apportion portion 24*f*.

An outer surface 32*s* of the first subpart 32 (an outer surface 10*s*) is formed as a curved face to form part of the spherical surface, and, similarly to the annular flat portion 31*e* of the first subpart 31, a flat face portion is formed on an inner face of the second subpart 32, so as to match with the second flat face portion 20*f*. In addition, three cutouts 32*b* are formed at an outer peripheral edge of the second subpart 32. Two of the three cutouts 32*b* engage with projection portions 22*cb* of a pair of second connecting parts 22*c* and the remaining one engages with an attachment hole projection 32*cb* in which an attachment hole 32*c* for attaching the character C is formed. That is, in the first form 1F, the second subpart 32 is held by engagement at the three portions thereby covering the second flat face portion 20*f*. Further, since the second subpart 32 is detached without being used in the second form 2F and the third form 3F, the pattern 10*m* is not formed thereon.

Figure 6:
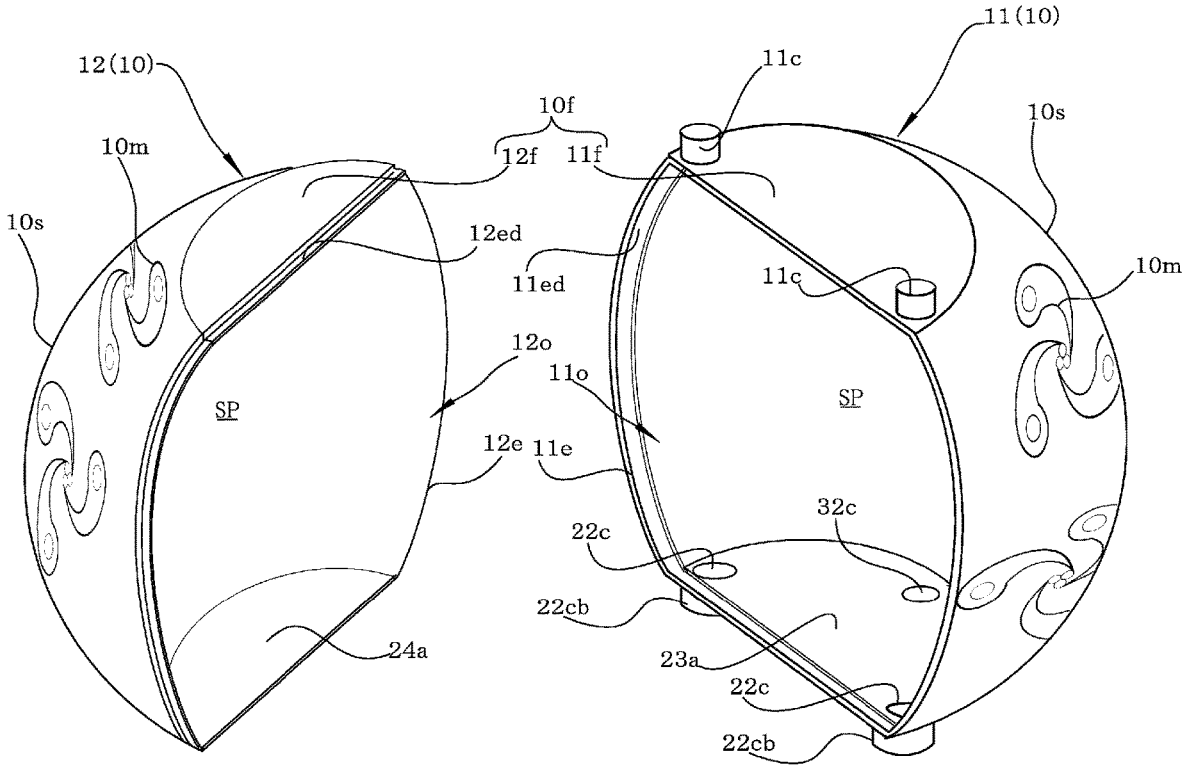
FIG. 6 is an exploded perspective view of a main part shown in FIG. 1.

FIG. 6 is an exploded perspective view of the main part 10. The main part 10 is made up of the first outer shell component 11 and the second outer shell component 12, as described above. As shown in FIG. 6, both the first outer shell component 11 and the second outer shell component 12 are respectively formed in a hemispheric shape. For example, opening edges 11*e* and 12*e* which form respective openings 11*o* and 12*o* of the outer shell components 11 and 12 are configured so as to be connected to each other, so that the spherical space SP is formed inside the main part 10 in the first form 1F.

More specifically, an inner step part 11*ed*, which is configured as a thin part so that an inner side of the opening edge is recessed, is formed along the opening edge 11*e* of the first outer shell component 11. On the other hand, an outer step part 12*ed* is formed along an opening edge 12*e* of the second outer shell component 12, wherein the outer step part 12*ed* is configured as a thin part, which is recessed on an outer side of the opening edge. When the outer step part 12*ed* of the second outer shell component 12 is inserted in the inner step part 11*ed* of the first outer shell component 11, both the outer shell components 11 and 12 are connected to each other, thereby forming the space SP in the first form 1F.

Further, the bulge (depth) of the first outer shell component 11 and that of the second outer shell component 12 are different from each other, and the size of the first outer shell component 11 is larger than that of the second outer shell component 12.

The pair of cylindrical first connecting parts 11*c* formed on the first apportion portion 11*f* is configured in such a size that the first connecting parts can be respectively inserted in the second connecting parts 22*c*, which are round though-holes and formed in the third apportion portion 23*f*. The distance between the pair of first connecting parts 11*c* is configured so as to be the same as that between the second connecting parts 22*c*. Therefore, the first connecting parts 11*c* of the first outer shell component 11 can be inserted in and connected to the second connecting parts 22*c* of another first outer shell component 11. By this configuration, a plurality of first outer shell components 11 can be connected to each other, so that a display form (a third form 3F), which is different from a single configuration in the second form 2F, can be assembled.

The first outer shell component 11 and the second outer shell component 12 are made of, for example, synthetic resin as material thereof so as to have an appropriate stiffness property. The pattern 10*m*, which is drawn on the outer surface 10*s*, appropriately relates to the character C so that the pattern 10*m* evokes the character C. Further, the color of the outer shell components 11 and 12 is not limited specifically, but may be formed by light transmissive material.

Figure 7:
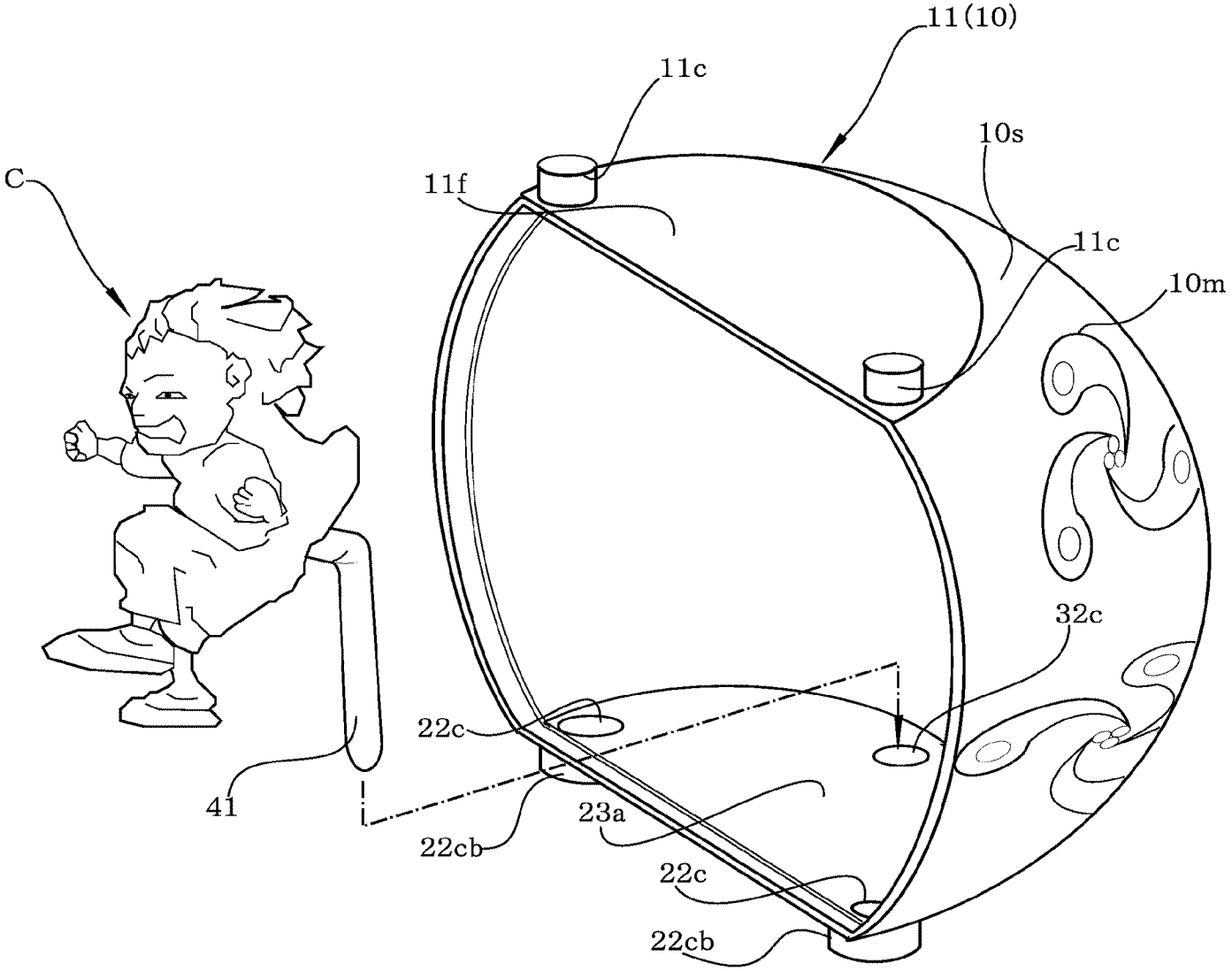
FIG. 7 is a perspective view for illustrating attachment of a figure in a displayed state.
Figure 8:
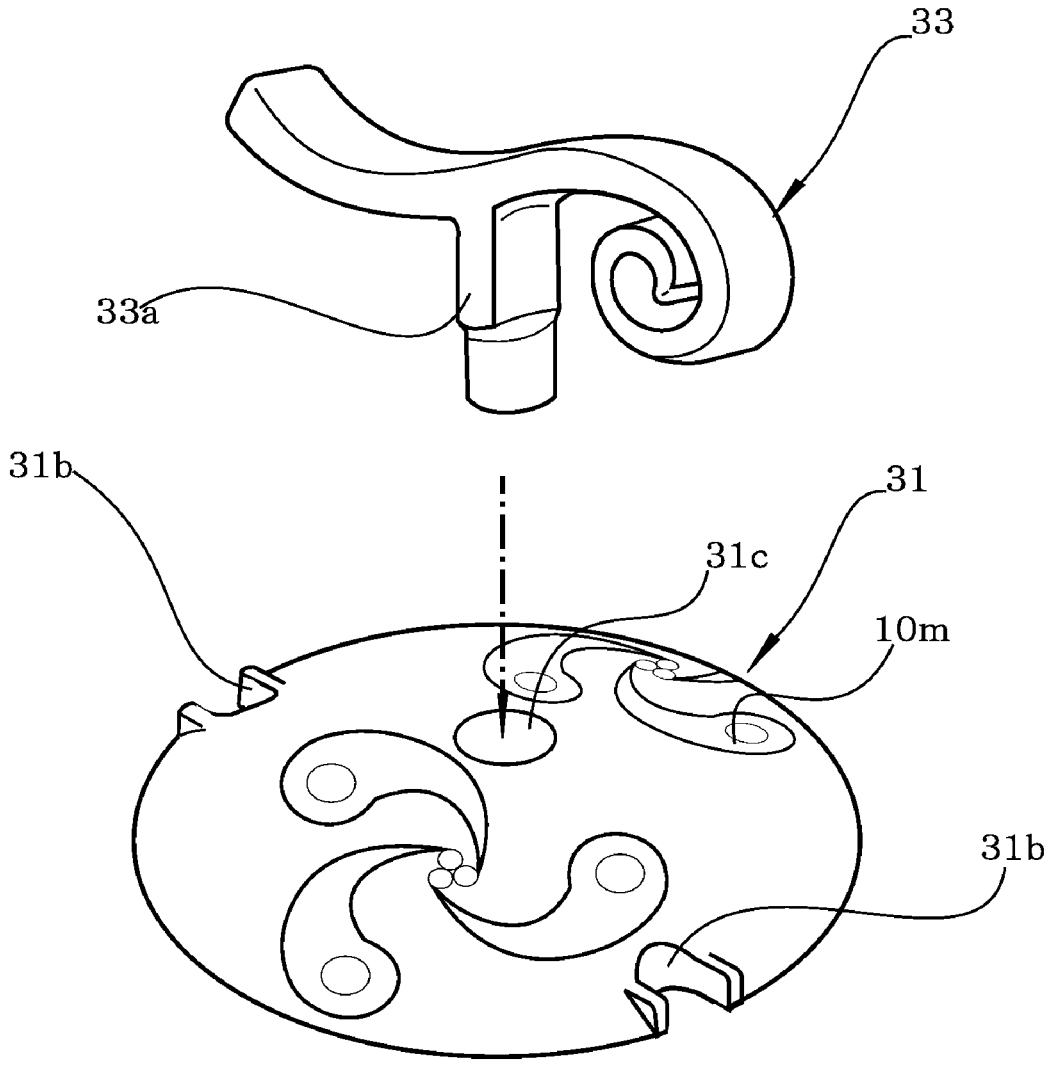
FIG. 8 is a perspective view for illustrating attachment of a third subpart in a display state.

FIG. 7 is a perspective view for illustrating assembly of the character C in a displayed state. FIG. 8 is a perspective view for illustrating assembly of the third subpart 33 in the display state. As shown in FIG. 7, a holding rod 41, which extends downwardly (the same direction as that of leg portions), is formed on a back side of the body of the character C. On the other hand, an apportion flat portion 23*a* on an inner face side of the third apportion portion 23*f* of the first outer shell component 11 has an area capable of attaching the character C thereto, and an attachment hole 32*c*, in which the holding rod 41 can be inserted and fit, is formed therein. The character C is held on the apportion flat portion 23*a* in the second form 2F and the third form 3F. In addition, since projections 32*cb* for the attachment hole, which extend toward a side of the third apportion portion 23*f* (a lower side in the figure), are formed, a room for inserting the holding rod 41 is secured in a portion where the attachment hole 32*c* is formed.

As shown in FIG. 8, the third subpart 33 is formed in a shape imitating, for example, a stalk end of a fruit. For example, an axis part 33*a*, which is connected to a main body side of the fruit, is inserted in an insert hole 31*c* of the first subpart 31. The third subpart 33 decorates an upper part of the main part 10 in a displayed state (refer to FIG. 9) in which the main part 10 formed in the shape imitating such a fruit is displayed. A cross section shape of a leading end (to be inserted) of the axis part 33*a* is circular, so that the attachment orientation thereof may be set accordingly. However, it may be non-circular so that the orientation thereof may be predetermined. Further, since in the first form 1F, the first subpart 31 is covered and held by a wrapping film 80 (refer to FIG. 2), the third subpart 33 cannot be attached to the first subpart 31 and accommodated in the space SP.

Figure 9:
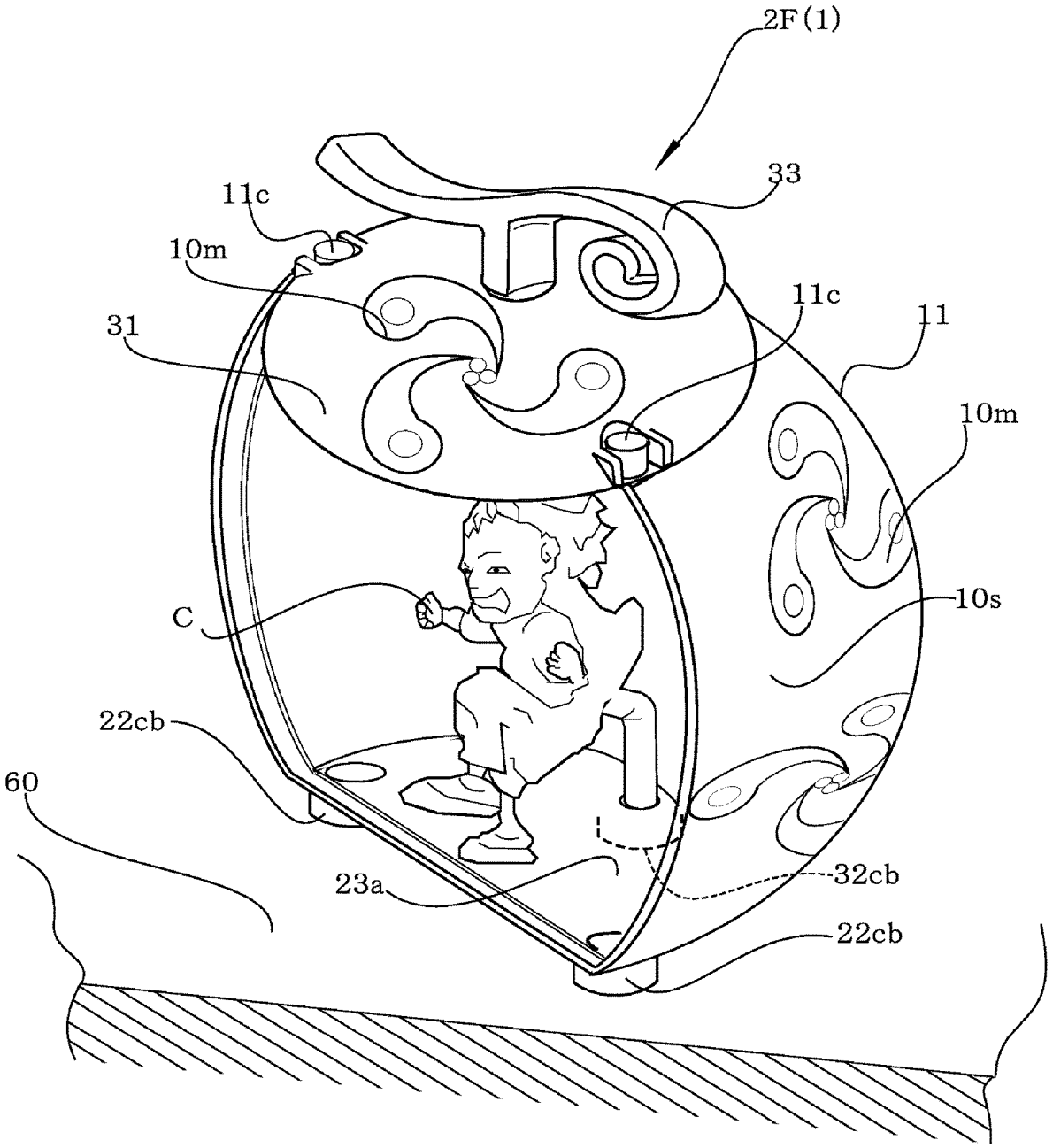
FIG. 9 is a perspective view showing an example of the toy in a second form.

FIG. 9 is a perspective view of an example in a second form 2F. In the displayed state shown in FIG. 9, a character C is displayed by using the first outer shell component 11, the first subpart 31 and the third subpart 33. In this case, similarly to the first form 1F, the first subpart 31 is attached and fixed to the connecting parts 11*c* of the first outer shell component 11. Further, since the three projection portions (the pair of projection portions 22*cb* and the attachment hole projection 32*cb*) are formed on a back side of the first outer shell component 11 in FIG. 9, the first outer shell component 11 can be stably placed on a placing face 60. In addition, according to the present embodiment, no pattern is formed on the inner face of the first outer shell component 11. However, when the outer shell component 11 is made of light transmitting material, the pattern 10*m* formed on the outer surface 10*s* can be seen from an inner side thereof due to the light transmission.

Figure 10:
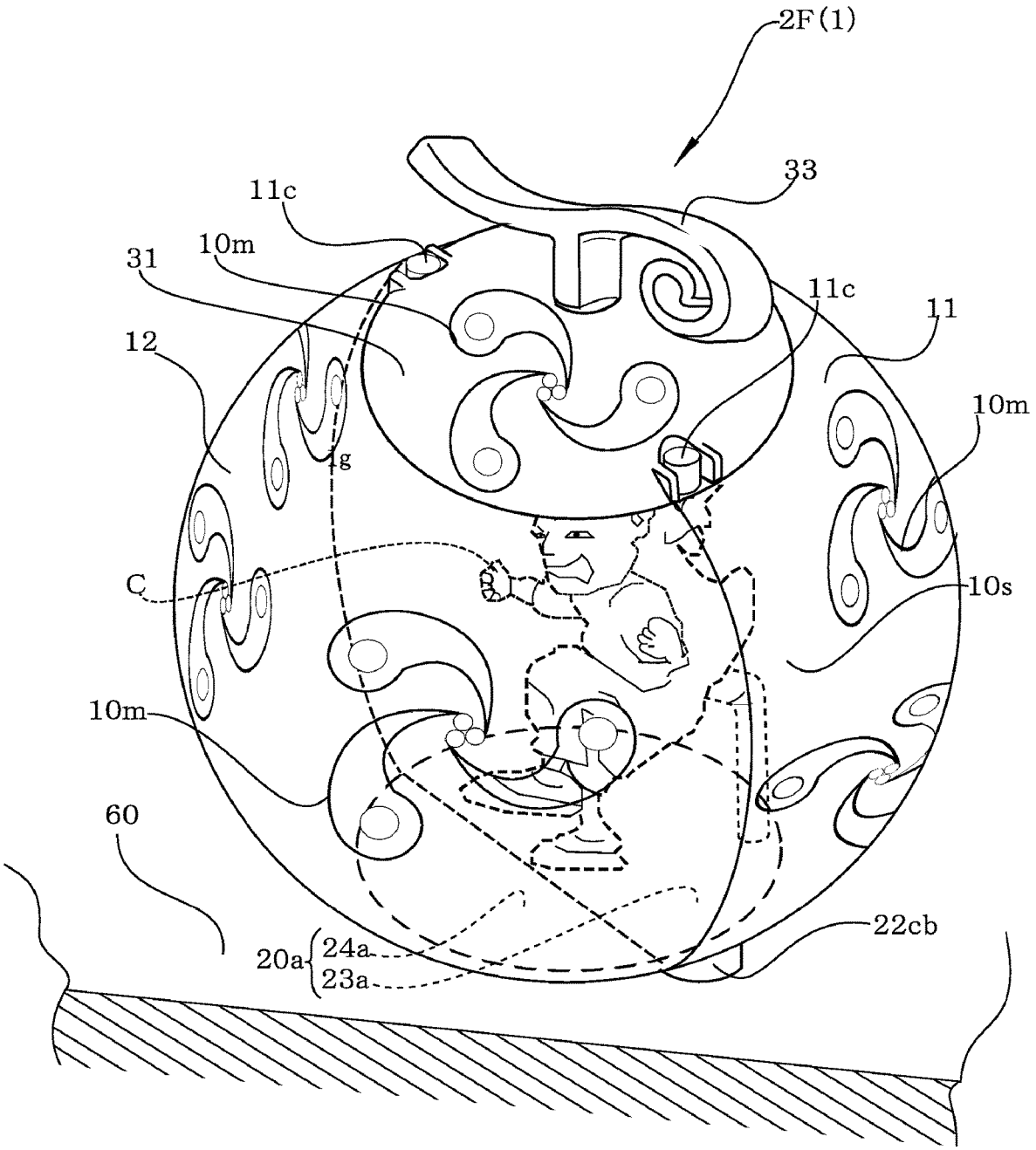
FIG. 10 is a perspective view of another example of the toy in the second form.

FIG. 10 is a perspective view of another example in the second form 2F. In the displayed state shown in FIG. 10, the character C is displayed in a closed sphere by using the first outer shell component 11, the second outer shell component 12, the first subpart 31 and the third subpart 33. In this case, the character C is fixed as in the case of FIG. 9, and the spherical fruit is formed by using all the components other than the second subpart 32.

In this case, a placing face for the character C is formed by a flat portion 20*a* having a large area (a portion on the inner side corresponding to the second flat portion 20*f*) wherein the flat portion 20*a* (a flat portion on an inner side thereof, corresponding to the second flat portion 20*f*) is formed by joining the apportion flat portion 23*a* of the first outer shell component 11 and an apportion flat portion 24*a* of the second outer shell component 12 to each other, so that it becomes possible to display a much larger character C. Further, specifically, the second outer shell component 12 is configured to have a good light transmittance, thereby effectively setting off the character C, which is placed within the pattern 10*m* drawn on the outer surface 10*s* in the display state.

Figure 11:
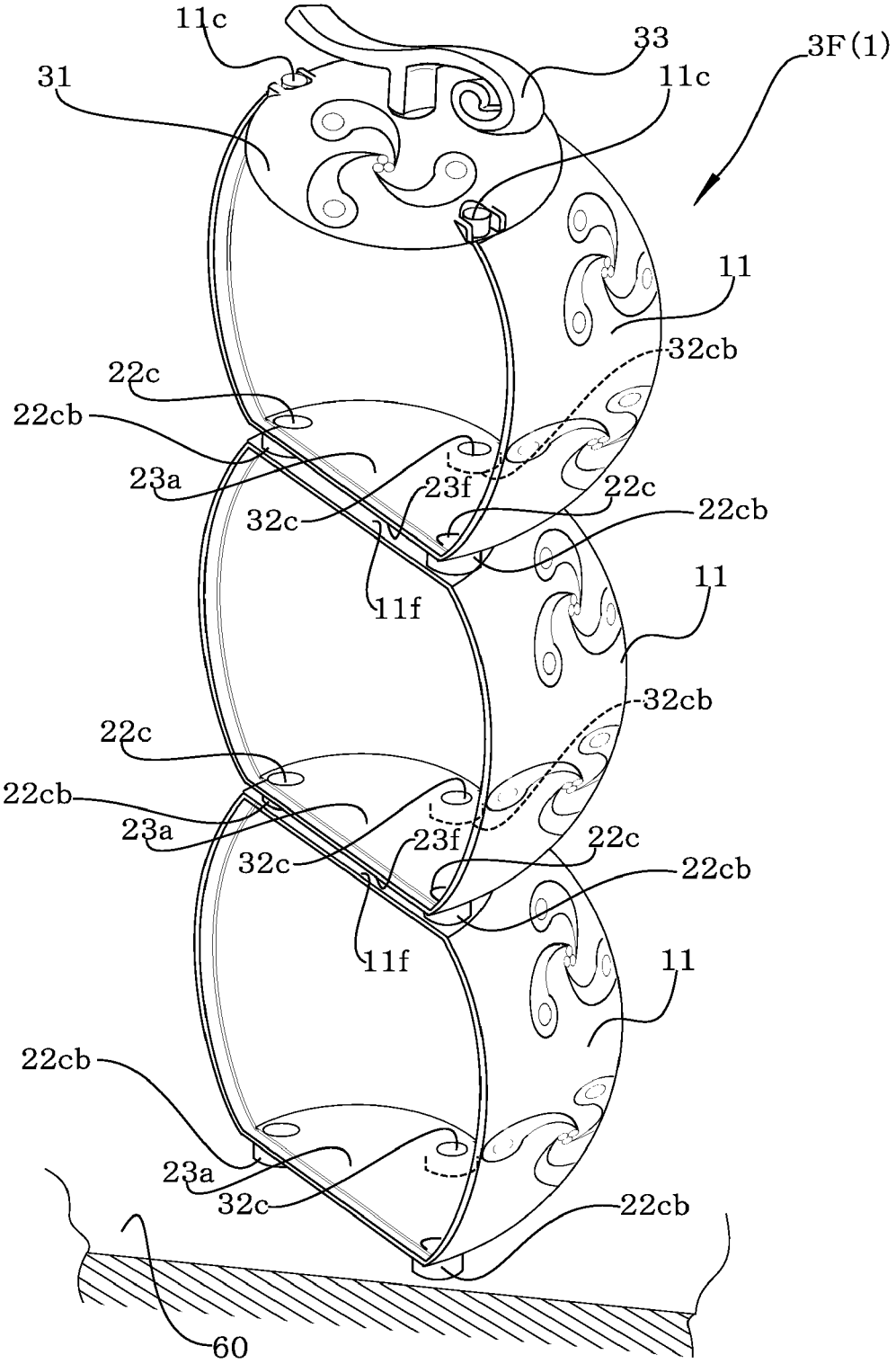
FIG. 11 is a perspective view of an example of the toy in a third form.

FIG. 11 is a perspective view of an example in the third form 3F. FIG. 11 shows a first display state of the third form 3F as another example of the display form, in which three first outer shell components 11 are connected in a vertical direction. In the third form 3F, a third apportion portion 23*f* of one of the first outer shell components 11 which are vertically adjacent to each other, is connected to a first apportion portion 11*f* of the other first outer shell component 11 at a position where they face each other in one-to-one basis. Specifically, a pair of the first connecting parts 11*c* of the first outer shell component 11 located on a lower side thereof and a pair of the second connecting part 22*c* of the first outer shell component located on an upper side thereof are interlocked with each other. Further, an attachment hole projection 32*cb* of the first outer shell component 11 located on the upper side is in contact with the first apportion portion 11*f* of the first outer shell component 11 on the lower side, and the first apportion portion 11*f* of the first outer shell component 11 on the lower side thereof and the third apportion portion 23*f* of the first outer shell component 11 on the upper side thereof are vertically connected to each other in a line in a state where a gap is formed therebetween as shown in the figure. Further, the first subpart 31 in which the third subpart 33 is incorporated, can be attached to only the first apportion portion 11*f* which is located at the highest position thereamong. In this display state, a long, slender and high display form be formed.

Figure 12:
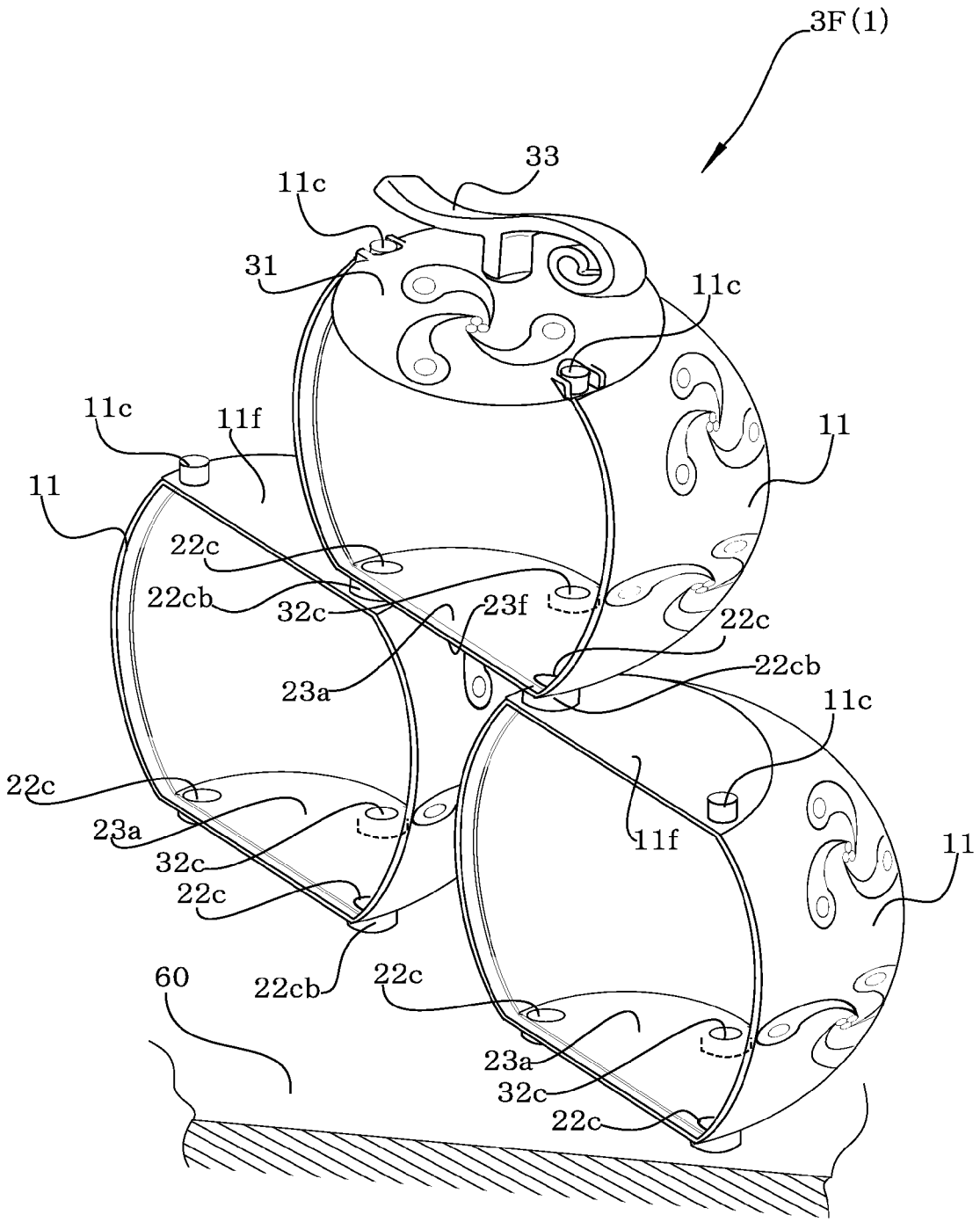
FIG. 12 is a perspective view of another example of the toy in the third form.

FIG. 12 is a perspective view of another example in the third form. FIG. 12 shows a second display state thereof as another example, wherein one first outer shell component 11 and two first outer shell components 11, to which the one first outer shell component 11 is attached, are connected to one another to form a pyramid shape (or a triangle shape) arrangement. In this display state of the third form 3F, the first apportion portions 11*f* of the two outer shell components 11 on the lower side are connected to the third apportion portion 23*f* of the one first outer shell component 11 on the upper side, so as to correspond to each other in a ratio of two to one. That is, this second display state is a connection state where one of the first connecting parts 11*c* of each of the two first outer shell components 11 is inserted in one of the second connecting parts 22*c* of the first outer shell component 11 on the upper side. Further, although the pyramid shape made of three pieces is shown in this figure, additionally three first outer shell components 11 may be connected below the two first outer shell components shown in the figure. In such case, the first subpart 31 in which the third subpart 33 is incorporated can be attached to only the first apportion portion 11*f* of the first outer shell component 11 which is located at the highest position. In this display form, a stable display state can be created.

Figure 13:
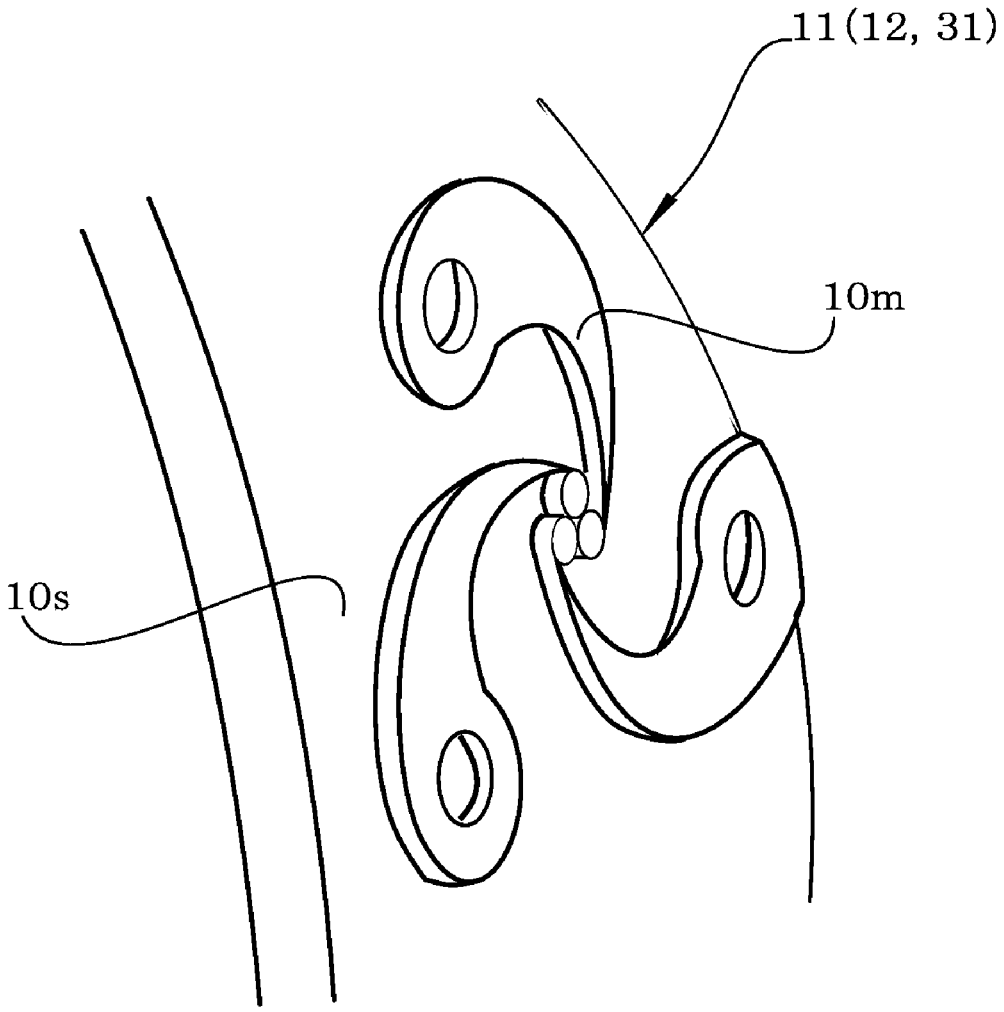
FIG. 13 is an enlarged perspective view showing a state of formation of a pattern.

FIG. 13 is an enlarged perspective view of a formed pattern. The pattern 10*m* which is formed on the outer surface 10*s* of each of the first outer shell component 11, the second outer shell component 12, and the first subpart 31, may be drawn by printing. For example, as shown in FIG. 13, the entire pattern 10*m* may be shaped in a protruded form which rises from the outer surface 10*s*. Or differently from the protruded form, the outer surface 10*s* may be imprinted so that it may be in a concave form. Or the pattern 10*s* may be formed by using a groove form etc. in which a linear groove may be formed along the contoured part of the pattern 10*m*.

In the state where the pattern 10*m* is formed, when a concavity and convexity shape is formed on a surface of resin, if material of the first outer shell component 11 etc. is made of light transmissive resin, specifically, it is possible to bring about change in the pattern 10*m* by using transmittance of light and further refraction of light due to uneven part of the surface and the thickness thereof. Further, even when the pattern 10*m* is formed only on the outer surface 10*s* and a pattern is not directly drawn on a wall behind the character C, a subtle pattern performance becomes possible by a cooperation of a color pattern and an indirect performance which uses the thickness of the wall and light refraction (specifically, in case where the transparency thereof is high). Further, although the pattern 10*m* is formed on only the outer surface 10*s* in the figure, it may be formed on an inner surface side.

As described above, since the toy according to the present embodiment has a spherical appearance and the space SP can be formed thereinside, the character C or the third subpart 33 etc. can be accommodated in the main part 10 in the first form 1F, and the character C can be displayed inside thereof. Further, in the first form 1F, since the toy itself can roll, it can be automatically sold by a vending machine such as an article supply device etc. Since the main part 10 is made up of the approximately hemispherical first and second outer shell components 11 and 12, and an opening edge 11*e* of the openings 1*o* and the opening edge 12*e* of the opening 12*o* are configured so as to be connected to each other, it is easy to change each form, and also easy to take the character C in and out.

Since the first flat portion 10*f* and the second flat portion 20*f* are formed as flat parts on the outer surface 10*s* of the spherically shaped main part 10 of the toy 1 according to the present embodiment, when the main part 10 is used in a display form (the second form 2F or the third form 3F), it may be stably placed on a placing face. Further, it is possible to form the flat portion 20*a* on the inner side of the second flat portion 20*f* or the flat portion 23*a* on the inner side of the third apportion portion 23*f*, so that the character C can be easily placed and displayed thereon. Moreover, such flat parts are formed on a component having a spherical appearance, so that not only the connecting structure (bumps and dips or holes) can be easily formed but it is possible to provide and maintain stability of the connected state by the connection in which the flat parts face each other.

Further, in the first form 1F of the toy 1 according to the present embodiment, the first subpart 31 is connected to the main part 10 through the first connecting parts 11*c*, and the second subpart 32 is connected thereto through the second connecting parts 22*c*, so that differently from case where the subparts 31 and 32 are merely placed on a flat part, both the subparts 31 and 32 are certainly locked and fixed thereto, thereby maintaining the spherical shape thereof together with the main part 10, without using the wrapping film 80.

Further, in the second form 2F or the third form 3F, the first subpart 31 to which the third subpart 33 has been attached, can be connected to the first connecting part 11*c* located at least at the highest position, so that the first subpart 31 can be certainly fixed and held as a decorative component in the display form.

Further, since the first flat portion 10*f* is configured so as to have the same size as that of the second flat face portion 20*f*, and both the flat face portions 10*f* and 20*f* are respectively formed at upper and lower positions (180 degrees opposite sides), when the main part 10 is used as a display component containing the character C, it is possible to create a comfortable exhibition with a stable shape balance in the vertical and horizontal dimensions.

In the toy 1 according to the present embodiment, since the first outer shell component 11 is configured so as to be larger in size than that of the second outer shell component 2, when the first outer shell component 11 is used by itself in a display form, it is possible to expand the exhibition area and create an impressive presentation.

In the toy 1 according to the present embodiments, since the size of the first apportion portion 11*f* and the third apportion portion 23*f* of the first outer shell component is configured so as to be larger in size than that of the second apportion portion 12*f* and the fourth apportion portion 24*f* of the second outer shell component 12, when the first outer shell component 11 is used in a display form, the display area of the character C can be enlarged. In addition, when the first outer shell components 11 are connected to each other, it is possible to expand the flat portion and to ensure better connection and fixation.

Furthermore, in the toy 1 according to the present embodiments, since the second subpart 32 which can be attached to the second flat face portion 20*f*, is provided, the projection structure formed on the second flat face portion 20*f* can be covered thereby, and it is possible to make the overall shape of the toy 1 approximate a sphere.

Further, in the toy 1 according to the present embodiment, since the first connecting part 11*c* is provided at one end of the first outer shell component 11, and the second connecting part 22*c* is provided at the other end, and further, since both the connecting parts 11*c* and 22*c* are configured to be connectable to each other, it is possible to connect two or more main parts 10 (first outer shell components 11) with each other. Furthermore, since two or more connection points of both connecting parts 11*c* and 22*c* are configured to be aligned, a one-to-many (even more than two is possible) connection form becomes possible by individually connecting them at the connecting points. As a result, it becomes possible to enjoy variations in connection forms and achieve a wide range of presentation effects.

In the toy 1 according to the present embodiments, since a similar kind of pattern 10*s* is formed on the outer surface of each of the first outer shell components 11, the second outer shell component 12 and the first subpart 31, which form the outer surface 10*s* of the main part 10, it is possible to achieve a performance, using the pattern 10*m* in either the first form 1F (sales form) or the display form.

Furthermore, when the pattern 10*m* is formed on the inner surface of the first outer shell component 11, it is possible to set off the character C by using the pattern on the inner surface.

Further, in the case where the first outer shell component 11 and the second outer shell component 12 are made of light transmitting material, even when only the pattern 10*m* is formed on the outer surface 10*s*, the pattern 10*m* can be seen in the display form from the inside of the outer shell component. In addition, when the character C is displayed in the spherical shape, it is possible to show that the character C is within the pattern 10*m* of the first outer shell component 11 and the second outer shell component 12.

In addition, the toy 1 according to the present embodiments, in the case where the pattern 10*m* includes expression based on concave and convex on a resin surface, such as concaves, projections, groove(s), specifically, when the material of the first outer shell component 11 etc. is light transmissive resin, it is possible to introduce changes to the pattern 10*m*, by utilizing the refraction of light and variations in shading, thereby achieving diversification in the presentation of the pattern 10*m* and enhancing the exhibition effects of character C.

As described above, the embodiment of the present application is explained. However, the present invention may be modified if needed within the technical idea. For example, although the second connecting part 22*c* is a through hole in the above-described embodiments, the element is not limited thereto, and may be formed in a concave shape. Further, in the above-described embodiment, the attachment cutouts 31*b* is formed in a cutout shape, but is not limited thereto and may be an insertion hole. Moreover, the shape of the first flat face portion 10*f* and the second flat face portion 20*f* is configured so as to be approximately circular in the above-described embodiment. However, it may not necessarily be circular. For example, when the main part 10 is formed in an awkward spherical shape, they are formed in a shape which is not circular, accordingly.

REFERENCE NUMERALS

1 Toy
1F First form
2F Second form
3F Third form
Main part
10*f* First flat face portion
10*m* Pattern
10*s* Outer surface
11 First outer shell component
11*c* First connecting part
11*f* First apportion portion
11*o* Opening of the first outer shell component
12 Second outer shell component
12*f* Second apportion portion
12*o* Flat portion
22*c* Second connecting part
20*f* Second flat face portion
23*f* Third apportion portion
23*a* Apportion flat portion
24*f* Fourth apportion portion
31 First subpart
32 Second subpart
33 Third subpart
60 Placing face
C Character (object)
SP Space

The invention claimed is:

1. A toy capable of transforming into a first form where the toy can be supplied from an article supply device, and a second form where an object can be displayed, comprising:

a main part in a spherical shape, wherein a first flat face portion is formed on a first portion of an outer surface of the main part, and a second flat face portion is formed on a second portion thereof, which is different from the first portion, wherein the main part comprises a first outer shell component and a second outer shell component connectable to the first outer shell component, and the first outer shell component is larger in size than that of the second outer shell component, each of the first outer shell component and the second outer shell component has an opening portion and is in a hemispherical shape, and edge portions of the opening portions are configured so as to be connectable to each other, and the first flat face portion is apportioned to the first outer shell component and the second outer shell component, and the size of the first apportion portion which forms the first flat face portion in the first outer shell component on one side thereof, is larger than that of the second apportion portion which forms the first flat face portion in the second outer shell component on the other side thereof.

2. The toy according to claim 1, wherein the main part is configured so that the object can be accommodated therein in the first form and the second form.

3. The toy according to claim 1, wherein the first flat face portion is the same in size as that of the second flat face portion.

4. The toy according to claim 1, wherein the second flat face portion is apported to the first outer shell component and the second outer shell component, and a size of a third apportion portion which forms the second flat face portion of the first outer shell component on one side thereof is larger than that of a fourth apportion portion which forms the second flat face portion of the second outer shell component on the other side.

5. The toy according to claim 4, wherein the first outer shell component is configured so that the object is displayable on an apportion flat portion on an inner face side thereof corresponding to the third apportion portion of the first outer shell component, in the second form in which the first outer shell component is separated from the second outer shell component.

6. The toy according to either claim 4, wherein the first outer shell component and the second outer shell component are configured so that the object is displayable on a flat portion of the second flat face portion on an inner face side corresponding to the second flat face portion formed on the first outer shell component and the second outer shell component, in the second form in which the edge portion of the opening portion of the first outer shell component and that of the second outer shell component are connected to each other.

7. The toy according to claim 4, further comprising a first subpart attachable to the first flat face portion and a second subpart attachable to the second flat face portion in the first form, wherein the second subpart is detached in the second form.

8. The toy according to claim 7, wherein a first connecting part is formed on the first apportion portion of the first outer shell component, and a second connecting part is formed on the third apportion portion thereof.

9. The toy according to claim 8, wherein the first connecting part is configured so as to be connectable to the second connecting part of the first outer shell component of another toy, and the toy is transformed into a third form in which the object can be displayed differently from that in the second form, by connecting the first connecting part and the second connecting part to each other.

10. The toy according to claim 9, wherein the third form includes a first display state in which the third apportion portion of one of the first outer shell components and the first apportion portion of another one of the first outer shell components correspond one-to-one with and connected to each other, and a second display state in which the third apportion portion of the one of the first outer shell components and the first apportion portions of two other first outer shell components correspond one-to-two with and connected to each other.

11. The toy according to claim 8, where in the first state, the first subpart is connected to the first outer shell component through the first connecting part, and the second subpart is connected to the first outer shell component through the second connecting part.

12. The toy according to claim 10, wherein the first subpart is configured so as to be attachable to only the first flat face portion or the first apportion portion, which is located at the highest position, in the third form.

13. The toy according to claim 7, further comprising a third subpart, wherein the first subpart is configured so that the third subpart is unattachable thereto in the first form, and the third subpart is attachable thereto in the second form.

14. The toy according to claim 13, wherein the main part has a shape imitating a fruit of a plant, and the third subpart has a shape imitating a stalk end of the plant.

15. The toy according to claim 7, wherein a same kind of pattern is formed on an outer surface of the first outer shell component, that of the second outer shell component, and that of the first subpart.

16. The toy according to claim 1, wherein the object is an article in shape of a character.

* * * * *